United States Patent [19]

Shepherd et al.

[11] Patent Number: 4,716,605

[45] Date of Patent: Jan. 5, 1988

[54] LIQUID SENSOR AND TOUCH CONTROL FOR HYDROTHERAPY BATHS

[76] Inventors: Philip E. Shepherd, 5608 Melody Lake Dr., Edina, Minn. 55436; Gregory R. Johnson, 4940 173rd Ave. NE., Ham Lake, Minn. 55304

[21] Appl. No.: 901,554

[22] Filed: Aug. 29, 1986

[51] Int. Cl.[4] ..... E03C 1/05

[52] U.S. Cl. ..... 4/544; 4/623

[58] Field of Search ..... 4/544, 541, 507–509, 4/192, 193, 623, 302, 304, 305, 542, 546, 535; 128/369, 400, 66

[56] References Cited

U.S. PATENT DOCUMENTS

| | | | |
|---|---|---|---|
| 3,415,278 | 10/1968 | Yamamoto et al. . | |
| 3,556,146 | 1/1971 | Groen . | |
| 3,575,640 | 4/1971 | Ishikawa | 4/304 |
| 3,809,116 | 5/1974 | Sanner | 4/507 |
| 4,169,293 | 10/1979 | Weaver | 4/544 |
| 4,216,411 | 8/1980 | Ehret et al. . | |
| 4,233,694 | 11/1980 | Janosko et al. | 4/544 |
| 4,237,562 | 12/1980 | DuPont | 4/543 |
| 4,404,697 | 9/1983 | Hatcher | 4/496 |
| 4,563,780 | 1/1986 | Pollack | 4/192 |
| 4,564,962 | 1/1986 | Castleberry et al. | 4/543 |

FOREIGN PATENT DOCUMENTS

| | | | |
|---|---|---|---|
| 2853981 | 6/1980 | Fed. Rep. of Germany | 4/623 |
| 2075339 | 11/1981 | United Kingdom . | |

*Primary Examiner*—Henry J. Recla
*Assistant Examiner*—Leo Peters
*Attorney, Agent, or Firm*—James V. Harmon

[57] ABSTRACT

A hydrotherapy system is provided including a hydrotherapy tub with a water circulation pump and motor. Electrical proximity sensor terminals are mounted to the tub on the outside surface, one at a relatively low level for detecting the presence of water in the tub and a second preferably at a higher level for detecting the presence of the user to serve as an "on" and "off" switch which the user can operate by placing his hand in proximity therewith. Neither of the terminals requires physical contact to be actuated. Each is connected to circuit means for establishing the presence of an object in proximity with it and each of the terminals is operatively connected to the pump motor so that the pump motor will operate only when both of the terminals are actuated.

6 Claims, 5 Drawing Figures

LIQUID SENSOR AND TOUCH CONTROL FOR HYDROTHERAPY BATHS

FIELD OF THE INVENTION

The present invention relates to hydrotherapy tubs and pumping systems and more particularly to an improved hydrotherapy tub control system.

BACKGROUND OF THE INVENTION

Hydrotherapy tubs which are also sometimes referred to as whirlpool baths have become increasingly popular in the last few years, particularly for home use. In the home, the operation of the tubs is, of course, not carried out under the supervision of trained personnel and parts can be damaged under certain conditions. For example, operation of the system without water present can damage both the pump and operating motor and other malfunctions can occur. Moreover, the water can overflow if the hydrotherapy pump is operated with the water at too high a level in the tub. Moreover, if it is necessary for the user to operate a standard electrical switch while sitting in the tub, there is the possibility of an electrical shock. While others have proposed electrical sensors having no moving parts that need only to be touched to operate the control switch, it has been the practice to provide a grounding plate which extends through the tub wall and/or connected to metal plumbing, which must be touched by the user in order to operate the switch. Such systems make the switch easier to use but may not completely eliminate the electrical shock hazard.

Other water control systems have been previously proposed. For example, U.S. Pat. No. 3,415,278 provides two antennas on the side of an earthenware sink, each connected to an oscillator, one of which operates the cold water valve and one of which operates the hot water valve.

U.S. Pat. No. 3,556,146 employs capacitor plates which are located near the faucets of a sink. Each sensor has two capacitor plates connected to an electrical circuit with Zener diode and an impulse generator. If a hand is placed near one of the capacitors, it is grounded, thus reducing the output voltage, thereby turning on or off hot or cold water valves.

U.S. Pat. No. 4,169,293 shows that it is known to provide a microswitch for controlling the pump of a hydrotherapy tub.

In view of the deficiencies of the prior art, it is a general objective to provide noncontacting sensors for controlling the pump operation of a hydrotherapy tub wherein installation is simplified by having no contacts that pass through the tub wall while at the same time more positively eliminating leakage and the possibility of electrical shock. Another objective is to provide a reliable noncontacting sensor which will operate with a positive action merely by placing the hand in proximity to it so that no physical contact is required. A further objective is to eliminate deficiencies of electrical sensors previously employed which were subject to contamination as the result of soap film deposits or mineral deposits on exposed metal sensing pins previously required to project through the tub wall and to come in contact with water present in the tub. A further objective is to provide a highly reliable noncontacting proximity sensor for hydrotherapy tub control which can be easily calibrated at the factory or during installation and requires no further attention by the user.

A further objective is to provide a combination protective circuit for pump operation which requires both a predetermined amount of water present and noncontacting actuation by the operator for the pump to be turned on.

These and other objects will be apparent in view of the following detailed description which sets forth the invention by way of example.

SUMMARY OF THE INVENTION

In accordance with the present invention, a hydrotherapy system is provided including a hydrotherapy tub adapted to contain a quantity of water, a pump is connected to the tub and includes inlet and outlet ducts communicating through the tub wall, motors connected to the pump and at least one water level sensing electrode is connected in proximity to the outside surface of the tub wall to sense a predetermined quantity of water present in the tub and a electrical touch sensor is connected in proximity to the tub wall, sensor circuits are connected to each of the sensors, and logic decoding means is connected between the circuits and the pump for operating the pump only when both the water level sensor and touch sensor are actuated and latching circuit means is connected for maintaining the pump in operation when the touch sensor is no longer actuated or for shutting off the pump if the water level drops below the water sensor while the pump is running thus preventing pump damage.

In a modified form of the invention, an upper water level sensor is also provided to halt the operation of the pump when the water level becomes too high in the tub for satisfactory operation. If desired, the upper water level sensor can also be connected to electrically actuated water valves for turning off the water when the upper water level has been reached.

THE FIGURES

DETAILED DESCRIPTION OF THE INVENTION

Figure 1:
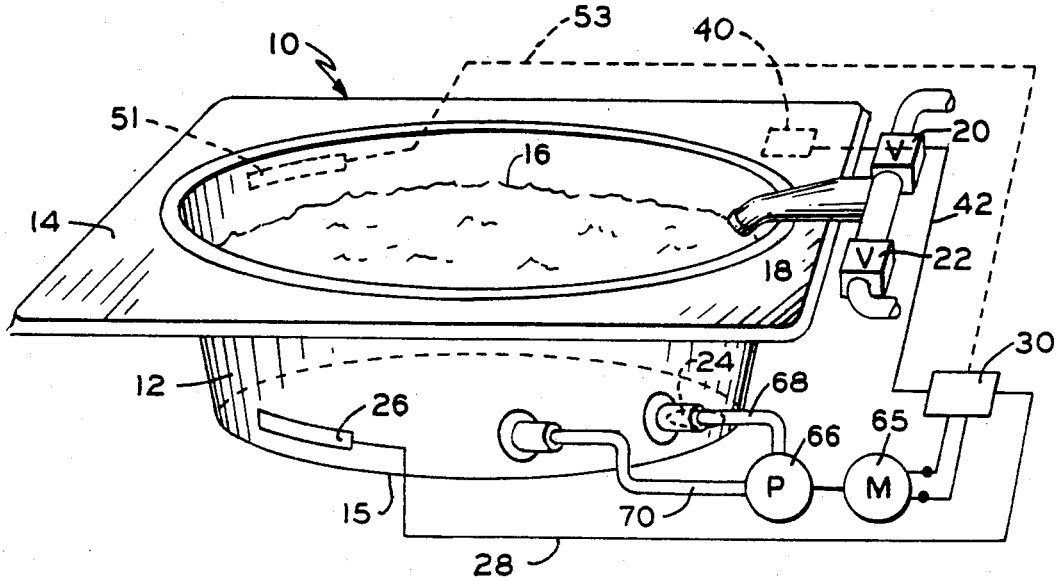
FIG. 1 is a diagrammatic combination perspective and circuit schematic in accordance with the preferred form of the invention.
Figure 2:
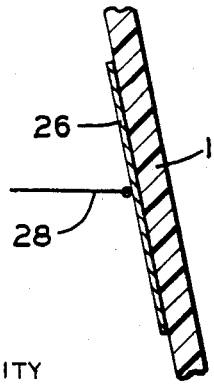
FIG. 2 is a vertical sectional view taken on line 2—2 of FIG. 1.
Figure 3:
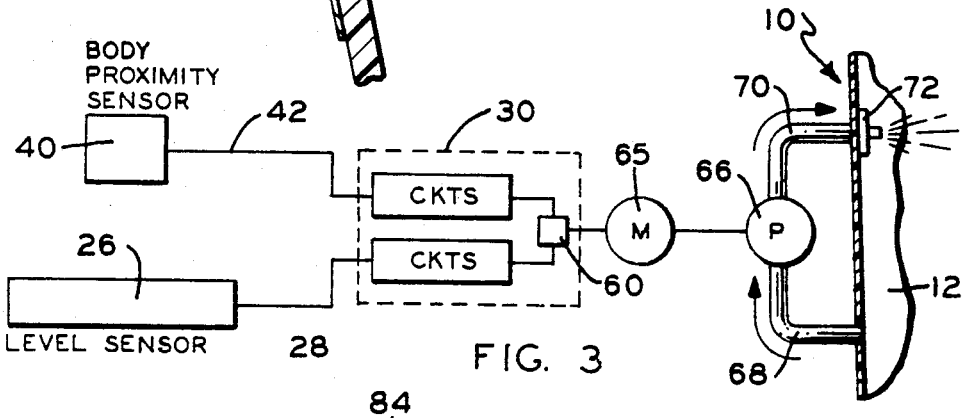
FIG. 3 is a block diagram showing one preferred form of the invention.

Refer now to the drawings and particularly to FIGS. 1–3. Shown in the drawing is a hydrotherapy or whirlpool tub 10 having a side wall 12 and a horizontally disposed mounting flange 14 which is mounted upon a flat surface such as a floor or other surface into which the tub is recessed. The tub is filled with water 16 and is filled through a faucet 18 controlled by hot and cold water valves 20 and 22. The faucet 18 and valves 20–22 are customarily mounted on the wall above the tub 10. The water 16 is drained through an outlet port 24 which is normally closed by a suitable drain opening which is normally plugged. The tub 10 is formed from a nonconductor of electricity such as vacuum formed plastic sheet, injection molded plastic, fiberglass or the like. Bonded by means of a suitable adhesive to the outside surface of the tub wall is a proximity sensor terminal consisting of a sheet of copper or other conductor 26 wired by means of conductor 28 to a control circuit 30. The sensor 26 in this case is a sheet of copper measuring 2 inches in height and 12 inches long mounted approximately 3 inches above the bottom wall 15 of the tub 10 to sense the presence of water in the tub and thereby serve as a lower level water sensor which during operation is used to prevent operation of a water circulating pump when there is no water in the tub. Within the electrical control 30 is a first proximity sensing circuit 32 wired via the conductor 28 to the sensor terminal 26. A second sensing plate or terminal 40 is bonded by means of a suitable adhesive to the lower surface of the flange 14. The sensor 40 functions as a proximity sensor that can be actuated by bringing a hand into its proximity. It thus functions as an operator controlled switch which can be actuated without actually contacting it. The terminal 40 can comprise a thin sheet of copper 3 x 4 inches. The terminal 40 is wired by means of a conductor 42 to the electrical control 30 which includes a second proximity sensing circuit 44.

If desired, a second water level sensing terminal 50 can be bonded to the outside surface of the tub 12 at a higher elevation typically just beneath the flange 14. The terminal 50 is similar to 26 and is wired when present by means of conductor 52 to electrical control 30 where it is connected to a proximity sensing circuit (not shown) but which is in all respects similar to the circuits 32 and 44.

The level and touch sensors 26 and 40 respectively are connected to oscillators 50 and 52 which are identical so that only one will be described in detail. Each of oscillators 50 and 52 employs an integrated circuit U1 comprising a CMOS RC timer/oscillator set up for free running oscillation with the frequency determined by the product of the capacitance 26 or 40 as the case may be and the sum of R1, R2 and R17, i.e., the RC time constant of the oscillator. With reference to U1, terminals 2 and 6 are wired to plate 26 or 40 for oscillator 52 and to potentiometer R1 which is also connected to pin 7 and cross resistor 17. Pin 7 is connected to a 5 volt power supply across dropping resistor R2. Pins 8 and 4 are connected to the power supply and across capacitance C15 to the other terminal of the power supply which is represented throughout the circuit diagram as a downwardly directed arrow. Pin 1 is grounded. Pin 5 is grounded through capacitor C1 and pin 3 is connected via resistor R12 and capacitor C2 to detection circuits 54 and 56 respectively. The common side of capacitors C2 and R12 is grounded through capacitor C7. The operation of the oscillators will now be described. The oscillators 50 and 52 oscillate at a frequency determined by the RC time constant of which C is the capacitance of the sensor plates 26 and 40. R1 is a potentiometer which allows for adjustment of the output frequencies. The frequencies produced equals the reciprocal of 1.4 times the RC constant. When water is in proximity to the plate 26 or the person's body approaches plate 40, the capacitance value changes thereby changing the output frequency of the oscillator. The capacitor C1 is used to improve the noise immunity of the circuits and help to prevent erratic operation. The output of U1 is a square wave which is converted to a sine wave by means of R12 and C7 for improved operation of the frequency decoders 54 and 56 to be described. The capacitors C2 are used to capacitively couple the oscillators and the frequency decoders.

The frequency decode/detection circuits 54 and 56 are also substantially identical. Each includes an integrated circuit U2. Pin 3 is connected to one of the oscillators through the capacitant C2, pin 4 is connected to the plus power supply and to the other terminal of the power supply through capacitor C16. Pin 5 is connected across resistor R3 to pin 6 which is connected to the negative terminal of the power supply through capacitance C3. Pins 7 and 2 are connected to the negative terminal of the power supply, the latter through capacitance C4. Terminals 1 and 8 are connected to the power supply across capacitor C5 and to each other through capacitor C13. Pin 8 is connected to the 5 volt power supply through resistor R4 and to the decoding logic 58 to be described below. The frequency decode/detection circuits 54 and 56 function as a phase lock loop. These circuits are set up to detect the output frequency of the oscillators and to provide an output signal when there is a change in the capacity of the sensors. R3 and C3 set up the center frequency. The center frequency in Hz is equal to the reciprocal of the RC time constant with R in ohms and C in farads. The detection band width is established by C4 and is approximately equal to 338 times the square root of the RMS voltage over the center frequency times the capacitance of plate 26 or 40 as the case may be in microfarads. The center frequency is set up so that when no person or water is present near the sensing terminals 26 or 40, the output will be in a "low" state. When the sensor is activated by the presence of water or a person's body, the frequency will change and exceed the limits of the band width established in the phase lock loop of the decode/detection circuits 54 and 56 and the output thereof will change to a "high" stage. Thus, either an increase or decrease in the capacitance of the sensor plates 26 or 40 will allow the phase lock loop frequency detection circuit to detect and respond. The capacitors C5 and C13 are used to eliminate the possibility of output "chatter" whenever the input frequency is riding around the minimum or maximum sides of the detection band width. They also set up the internal response speed/skew rate of the phase lock loop. R4 is a pull-up resistor on the output of the integrated circuit U2.

Both of the circuits just described feed into a decode logic circuit 58 which decodes the signals to provide proper signal to output relays and power up reset. Decoding logic is accomplished with integrated circuits U3 which is a NAND gate, multivibrator/one shot U6 and flip/flop U7.

Pin 6 of U3 is connected to pin 8 of U2. Pin 5 is connected to the 5 volt power supply across resistor R5 and diode CR1 in parallel thereto and to the negative terminal through capacitor C6. Pin 7 is grounded and 14 is connected to the positive terminal and to ground through capacitor C20. Pin 4 is connected to pin 10 of U7. The CLK pin of U6 is connected to pin 8 of U2, 5 is connected to 7 and pins 3 and 16 to the 5 volt power supply and to ground through capacitor C21. Capacitor C14 is connected across pins 1 and 2 and pin 2 is connected to the 5 volt power supply through resistor R10. Pin $\overline{Q}$ is connected to pin 11 of U7.

U7 is connected as follows: 9 to 12, 7 and 8 to ground, 10 to 4 of U3, 14 to 5 volt power supply and grounded via capacitor C25. Pin 13 is connected to pin 2 of a relay driver U8 through transistor Q1. Terminal 1 of U8 is connected to the 5 volt power supply through resistor R14 and pin 6 is connected to the pump motor via relay RY1, pin 4 is connected to an AC power source and the other side of the relay RY1 is connected to the other side of the power line. It is preferred that U8 is an optical isolating relay driver using light sources and photosensors to optically isolate circuits 50–58 from the power line.

Relay RY1 operates pump motor 65 which is connected as shown in FIGS. 1 and 3 to pump 66 having an inlet duct 68, an outlet duct 70 connected to hydrotherapy nozzle 72.

U3 is a Quad 2 input NAND gate which takes the output signal from U2 and the power-up reset signal generated by CR1, R5 and C6 to supply an indicator signal to U7. U6 is a dual precision retriggerable/resettable monostable multivibrator/one shot. R10 and C14 form the R/C time constant for the output pulse generated by U6 when it receives an input signal from U5. This pulse is fed into U7 and next sets or resets U7. U7 is a dual flip/flop, therefore the only time that the output relay will turn on is when there is a "low" signal on the reset pin 10 of U7 and an input pulse to the clock pin 11 of U7. When the touch sensor circuit is activated, there will be an input pulse to the clock pin 11 of U7 to turn on the relay driver and when the touch sensor circuits 52, 56 are activated again, the input pulse will change the output states of the U7 thus turning off the drive circuit to the relay RY1.

The relay drive circuit 60 is composed of transistor Q1, U8 and R14. Whenever the signal on the base of Q1 is low, the transistor will conduct thus allowing current to flow through the LED inside U8 and gating on the triac inside U8 causing relay RY1 to close causing pump motor to run. R14 is a current limiting resistor for the LED of U8.

Figure 4:
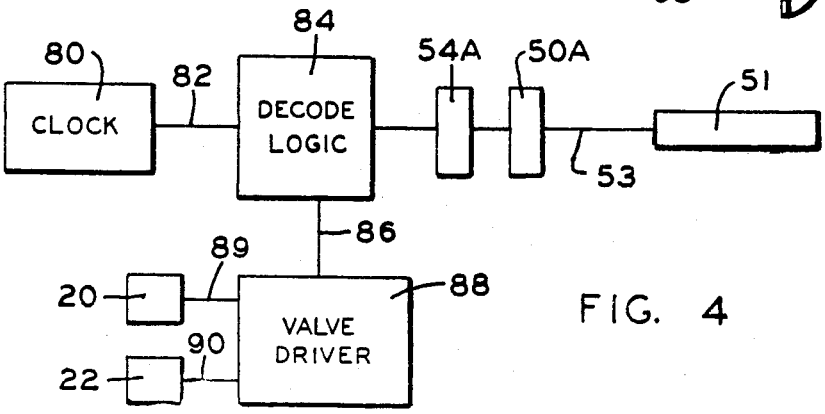
FIG. 4 is a block diagram showing another aspect of the invention.
Figure 5:
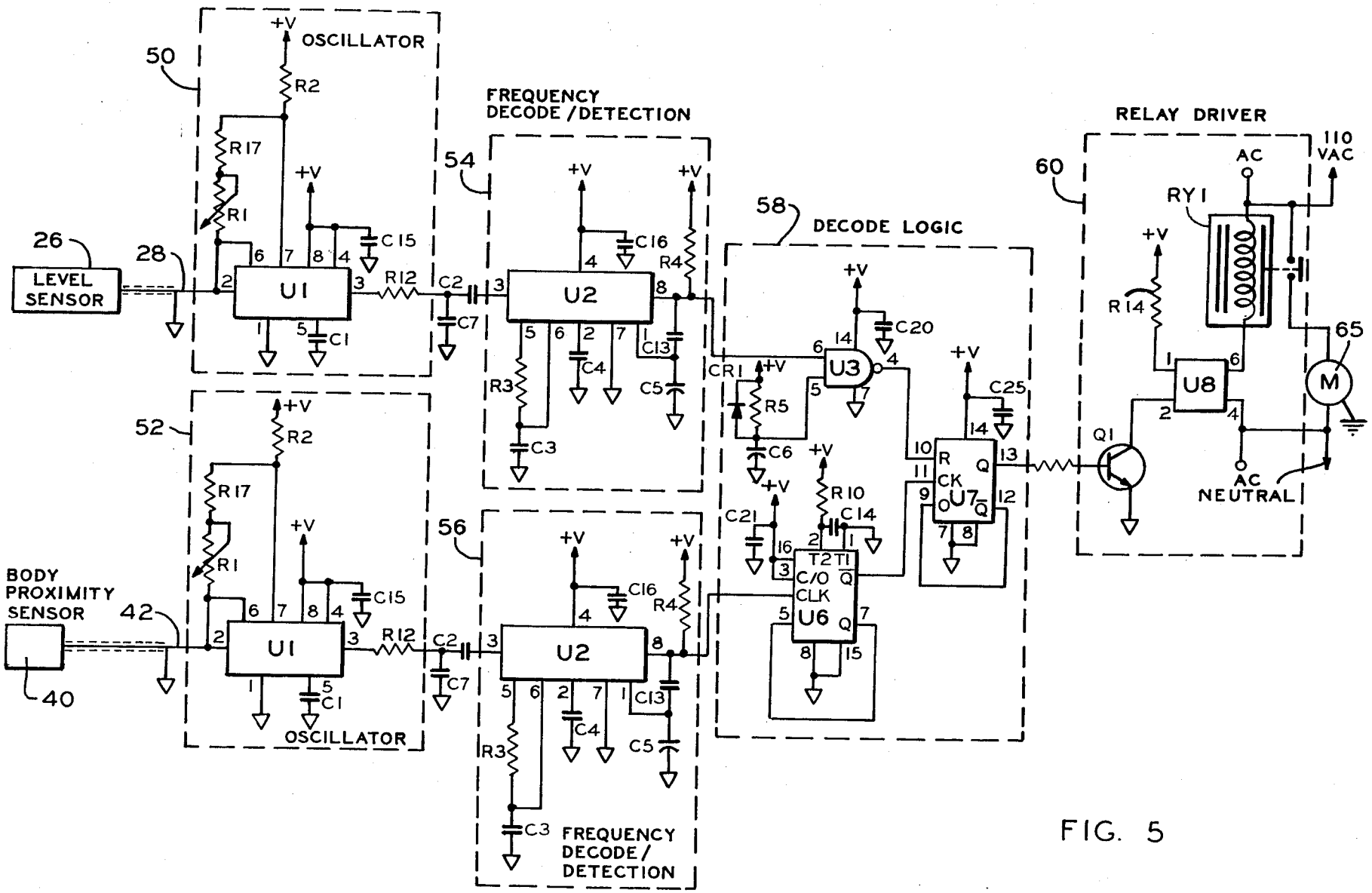
FIG. 5 is a schematic diagram showing one form of circuitry that may be used for water level sensing and touch control to operate either pumps or water valves.

Refer now to FIG. 4 which shows additional features of the invention. As shown in the figure, an electronic clock 80 is connected via conductor 82 to a decode logic circuit 84 of any suitable known construction which is coupled via conductor 86 to a valve driver 88, the valve driver, in turn, being connected by means of conductors 89 and 90 to solenoid operated valves 20 and 22 for controlling hot and cold water to the faucet 18. Thus the user may set the electronic clock 80 to the time desired for the tub to fill, say, 7:00 P.M. At the proper time, a pulse will travel through conductor 82 to the decode logic 84 which operates the valve driver 88, in turn causing the valves 20, 22 to open the proper amount. The optional upper water level sensor 51 can, if desired, be connected through a separate oscillator 50, a decoder/detector 54 to the decode logic 84 so that when water comes in proximity to the sensor plate 51,circuits 50A and 54A will detect the presence of the water whereupon decode logic 84 will turn off the valve driver 88 and valves 20 and 22. In the alternative, the upper level sensor plate 51 can be connected by conductor 53 as shown in FIG. 1 to the electrical control 30 (which in this instance will include a separate set of oscillator detector circuits 50 and 54) devoted to the plate 51 for controlling the motor 65 so that the motor 65 will not run when the water is too high in the tub.

Thus, in summary, it will be seen that the invention provides a hydrotherapy tub having a motor driven pump with inlet an outlet ducts communicating with the tub, electrical proximity sensor terminals mounted in the vicinity of the tub wall including a first sensor that is mounted relatively low in the tub to detect the presence of water and a second sensor mounted at a higher elevation and adapted to detect the presence of the human body in proximity therewith without physical contact required. Circuit means is provided for detecting the proximity of the water in the tub or the body as the case may be and circuit means is operatively connected to the sensor terminals for operating the motor only when both terminals are actuated indicating the presence of water in the tub and the presence of the human body. While not essential, it is desirable to provide instructions and preferably an indicator on the upper surface of the tub just above the terminal 40 to indicate that a person is to bring his hand into proximity with that point on the tub to actuate the terminal 40 and switch on the pump 65.

In a preferred form of the invention, each of the sensor plates is connected to oscillator mean such that the plates 40, 26 function as one capacitor plate of capacitors wired in the oscillator circuit. Each of the oscillators puts out an oscillating signal of a particular frequency which depends upon the R/C time constant of a selected resistance R and capacitor C of which the sensor terminal is one plate. Thus, when the hand is brought close to the sensor plate 40, the time constant of the oscillator changes and the oscillator puts out a signal of a different frequency. The tone of the oscillator is sensed by a frequency decode/detection circuit 54 or 56 as the case may be. When the tone changes to a certain degree, it is sensed as an "on" signal. The decode logic 58 functions to actuate the motor only when "on" signals ar provided from both of the sensors.

While the specific circuitry is given by way of example only in many variations as well as other suitable circuits will be apparent to those skilled in the art, the circuit illustrated has the advantage of providing a floating ground; in other words, the reference point provided by the center frequency of the oscillators floats and actuation with the hand or the presence of water will actuate the circuit whether the frequency of oscillation increases or decreases. Accordingly, it is not necessary to have a precisely established reference point. This is particularly advantageous in consumer installations since the quality of the ground provided varies from one locality to another and from one home to another. For example, in some homes plastic pipe is provided and a good ground may not be attainable. Nevertheless, the invention provides excellent sensitivity since sensing can be achieved by changes in frequency in either direction within the window provided by the band width selected for the detectors 54, 56. Consequently, it is not necessary to have a ground wire to the earth nor to contact metal. In addition, no physical contact is required with the sensors thereby reducing shock hazard and, if desired, the invention can provide both turning on the water circulation pump when a particular minimum water level is achieved and turning off the pump when an upper water level is achieved. If desired, a clock can be used to turn on solenoid operated water valves for filling the tub and an upper water level sensor can be employed for detecting the upper water level and turning off the water via a water valve driver connected to solenoid operated valves. While the sensitivity of the circuits can be varied to suit circumstances, it has been found that excellent operation can be achieved with the sensors 26 and 40 set to operate when the hand is brought to within an inch or two of the sensing terminal.

What is claimed is:

1. A hydrotherapy apparatus comprising a hydrotherapy tub, a water pump having inlet and outlet ducts connected to the tub and a drive motor connected to operate the pump, at least a pair of electrical proximity sensor terminals comprising two non-moveable electrodes supported in fixed positions at two different elevations and being mounted in the vicinity of the tub including a first terminal mounted at a relatively low level in the vicinity of the tub to sense the presence of water in the tub, the second terminal mounted in the vicinity of the tub for sensing the presence of the human body, but not being actuated by water in the tub, circuit means operatively connected between the terminals and the motor to energize the motor only when the first terminal is actuated by the presence of water in the tub and the second terminal is actuated by the presence of the human body in proximity or contact therewith whereby the motor will operate only when both terminals are actuated, the first terminal by the water and the second terminal by the human body.

2. The apparatus of claim 1 wherein a water sensing terminal is mounted at a relatively low elevation to detect a predetermined level of water in the tub and the second terminal is mounted at a higher elevation on the tub at a location where the user can bring his hand into proximity or contact therewith to actuate the same.

3. The apparatus of claim 1 wherein said circuit means comprises first and second oscillator means connected to the first and second terminals respectively, said oscillators including an RC time constant wherein C represents the capacitance one plate of which comprises one of said terminals whereby the change of capacitance thereof will change the frequency of the oscillator and detector circuit means is provided for sensing changes in the output tone of the oscillator and logic means is connected between the detector circuits and the motor to actuate the motor only when both of the sensor terminals have been actuated as a result of the capacitance changes caused by objects brought into proximity with the terminals.

4. The hydrotherapy system of claim 1 wherein at least one of the terminals is wired to an oscillator means to control the frequency thereof, a detection circuit is operatively associated with the oscillator circuit to receive the oscillating signal therefrom, said detection circuit includes circuit means establishing a detection band width establishing a predetermined frequency limits from the oscillator thereby detecting oscillator frequencies outside of said band width and including means when the band width is exceeded to thereupon provide an "on" signal and logic means connected to detection means wired to each of the sensors for turning on the motor only when "on" signals are received from both of the detection circuits.

5. The apparatus of claim 4 wherein an additional water level sensor terminal is provided in the vicinity of the tub and in proximity to the water in the tub when the tub is filled and operatively associated with the pump motor to deactive the pump motor when the water level has reached the level thereof.

6. The apparatus of claim 1 wherein the terminals comprise metal sheets bonded to the outside surface of the tub and the tub comprises a nonconductor of electricity.

* * * * *